US011982267B2

(12) United States Patent
Wackwitz et al.

(10) Patent No.: US 11,982,267 B2
(45) Date of Patent: May 14, 2024

(54) PORTABLE AIR COMPRESSOR

(71) Applicant: MILWAUKEE ELECTRIC TOOL CORPORATION, Brookfield, WI (US)

(72) Inventors: Jeffrey M. Wackwitz, Waukesha, WI (US); Troy C. Thorson, Cedarburg, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 18/126,523

(22) Filed: Mar. 27, 2023

(65) Prior Publication Data

US 2023/0243346 A1 Aug. 3, 2023

Related U.S. Application Data

(63) Continuation of application No. 16/404,048, filed on May 6, 2019, now Pat. No. 11,614,081.
(Continued)

(51) Int. Cl.
*F04B 39/12* (2006.01)
*F04B 35/04* (2006.01)
(Continued)

(52) U.S. Cl.
CPC ..... *F04B 39/121* (2013.01); *F04B 35/04* (2013.01); *F04B 35/06* (2013.01);
(Continued)

(58) Field of Classification Search
CPC ..... F04B 39/121; F04B 35/04; F04B 35/06; F04B 39/0027; F04B 39/0061; F04B 39/12; F04B 41/02
See application file for complete search history.

(56) References Cited

U.S. PATENT DOCUMENTS 4,988,268 A 1/1991 Kurihara
2006/0108970 A1 5/2006 Leasure et al.
(Continued)

FOREIGN PATENT DOCUMENTS

DE 29516321 U1 12/1995
JP 2002180971 A 6/2002
(Continued)

OTHER PUBLICATIONS

European Patent Office Partial Search Report for Application No. 19173099.3 dated Sep. 24, 2019 (12 pages).
(Continued)

*Primary Examiner* — Peter J Bertheaud
(74) *Attorney, Agent, or Firm* — Michael Best & Friedrich LLP

(57) ABSTRACT

An air compressor includes a compressor assembly with a motor and a pump driven by the motor, a battery receptacle, and a battery pack electrically connected to the motor via the battery receptacle for providing electrical power to the motor. The battery receptacle and the battery pack are positioned adjacent the compressor assembly. The compressor also includes a storage tank that receives compressed air from the pump, a case enshrouding the compressor assembly, an outlet port in fluid communication with the storage tank, and an adjustable pressure regulator at least partially positioned within the case. The outlet port configured to discharge compressed air from the storage tank at a regulated pressure determined by the pressure regulator. The compressor further includes an adjustment knob to adjust the regulated pressure of compressed air provided by the outlet port. The case attenuates noise emitted by the compressor assembly to less than 68 decibels.

21 Claims, 6 Drawing Sheets

Related U.S. Application Data

(60) Provisional application No. 62/667,976, filed on May 7, 2018.

(51) Int. Cl.
*F04B 35/06* (2006.01)
*F04B 39/00* (2006.01)
*F04B 41/02* (2006.01)

(52) U.S. Cl.
CPC ..... *F04B 39/0027* (2013.01); *F04B 39/0061* (2013.01); *F04B 39/12* (2013.01); *F04B 41/02* (2013.01)

(56) References Cited

U.S. PATENT DOCUMENTS

2008/0181794 A1* 7/2008 Steinfels ..... F04B 35/06 417/234
2009/0110566 A1 4/2009 Lucchi
2011/0182754 A1* 7/2011 Gathers ..... F16M 3/00 417/234
2015/0377230 A1 12/2015 Chou

FOREIGN PATENT DOCUMENTS

JP 2007040289 A 2/2007
JP 2009174490 A 8/2009
JP 2013231379 A 11/2013

OTHER PUBLICATIONS

Chinese Patent Office Action for Application No. 201920649522.2 dated Dec. 23, 2019 (2 pages including statement of relevance).
European Patent Office Extended Search Report for Application No. 19173099.3 dated Mar. 16, 2020 (11 pages).
European Patent Office Action for Application No. 19173099.3 dated Apr. 29, 2022 (5 pages).

* cited by examiner

PORTABLE AIR COMPRESSOR

CROSS-REFERENCE TO RELATED APPLICATIONS

This application is a continuation of U.S. patent application Ser. No. 16/404,048 filed May 6, 2019, now U.S. Pat. No. 11,614,081, which claims priority to U.S. Provisional Patent Application No. 62/667,976 filed on May 7, 2018, the entire contents of both of which are incorporated herein by reference.

FIELD OF THE INVENTION

The present invention relates to an air compressor, and more particularly to a portable air compressor.

BACKGROUND OF THE INVENTION

A compressor is a mechanical device that increases the pressure of a gas by reducing its volume. Generally, compressors are used to fill objects, such as vehicle tires, bicycle tires, sports balls, float tubes, and the like, with compressed air. However, such air compressors are usually loud and can be disturbing to the surrounding area.

SUMMARY OF THE INVENTION

The present invention provides, in one aspect, an air compressor including a compressor assembly having an electric motor and a pump driven by the motor, a battery receptacle, and a battery pack electrically connected to the motor via the battery receptacle for providing electrical power to the motor. The battery receptacle and the battery pack positioned adjacent the compressor assembly. The air compressor also includes a storage tank that receives compressed air from the pump, a case entirely enshrouding the compressor assembly, an outlet port in fluid communication with the storage tank, and an adjustable pressure regulator at least partially positioned within the case. The outlet port is configured to discharge compressed air from the storage tank at a regulated pressure determined by the pressure regulator. The air compressor further includes an adjustment knob to adjust the regulated pressure of compressed air provided by the outlet port. The case attenuates noise emitted by the compressor assembly to less than 68 decibels.

The present invention provides, in another aspect, an air compressor including a compressor assembly having an electric motor and a pump driven by the motor, a storage tank that receives compressed air from the pump, a battery receptacle, and a battery pack electrically connected to the motor via the battery receptacle for providing electrical power to the motor. The battery receptacle and the battery pack are positioned adjacent the compressor assembly. The compressor also includes a case supporting the battery receptacle and the battery pack, an outlet port in fluid communication with the storage tank, and an adjustable pressure regulator at least partially positioned within the case. The outlet port configured to discharge compressed air from the storage tank at a regulated pressure determined by the pressure regulator. The air compressor further includes a control panel disposed on a first side of the case. The control panel includes an adjustment knob to adjust the regulated pressure of compressed air provided by the outlet port, a gauge that displays the regulated pressure of the compressed air discharged from the outlet port, and an actuator to selectively activate the compressor assembly. Noise emitted by the compressor assembly is less than 68 decibels.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
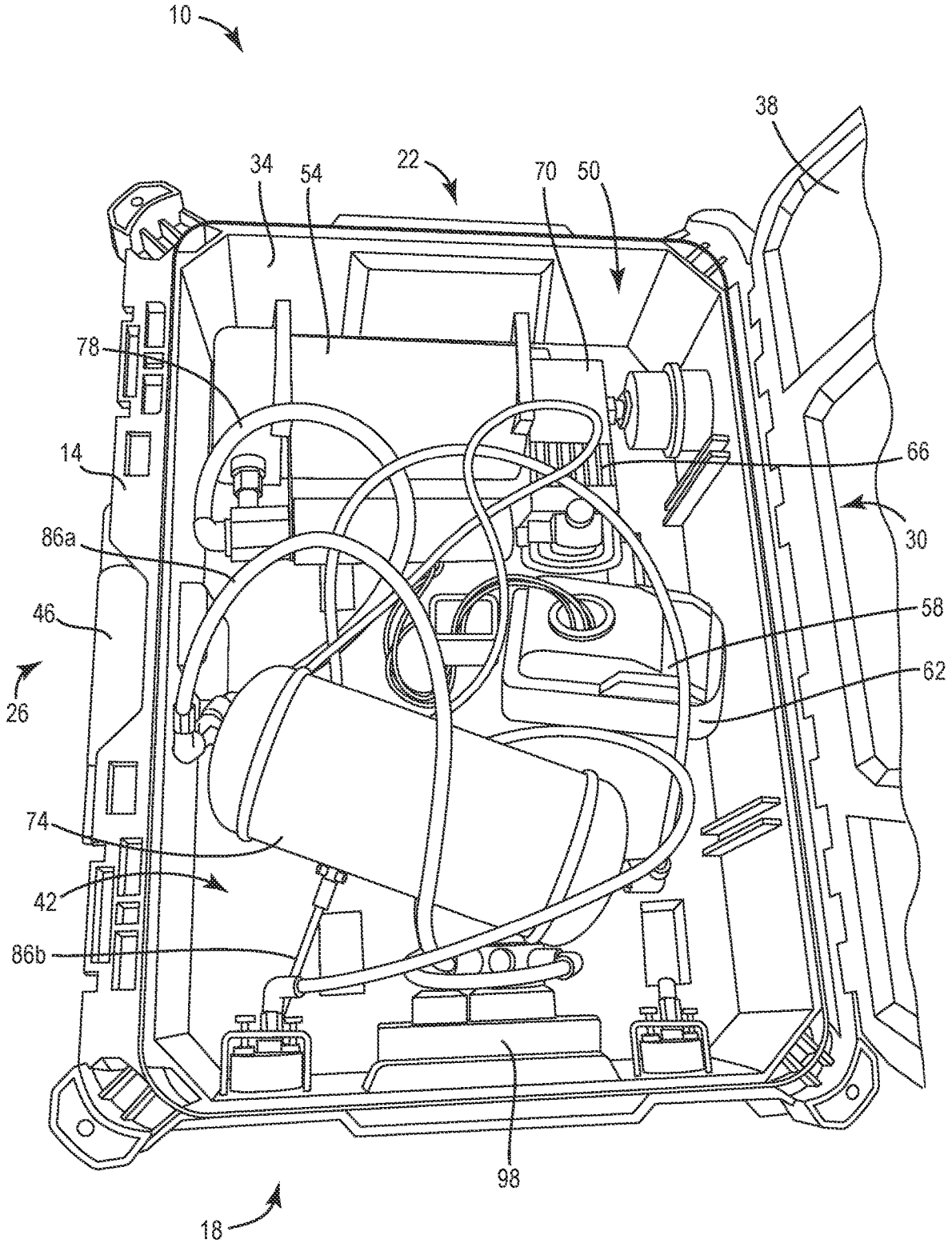
FIG. 1 is a top view of a portable air compressor in accordance with an embodiment of the invention.
Figure 2:
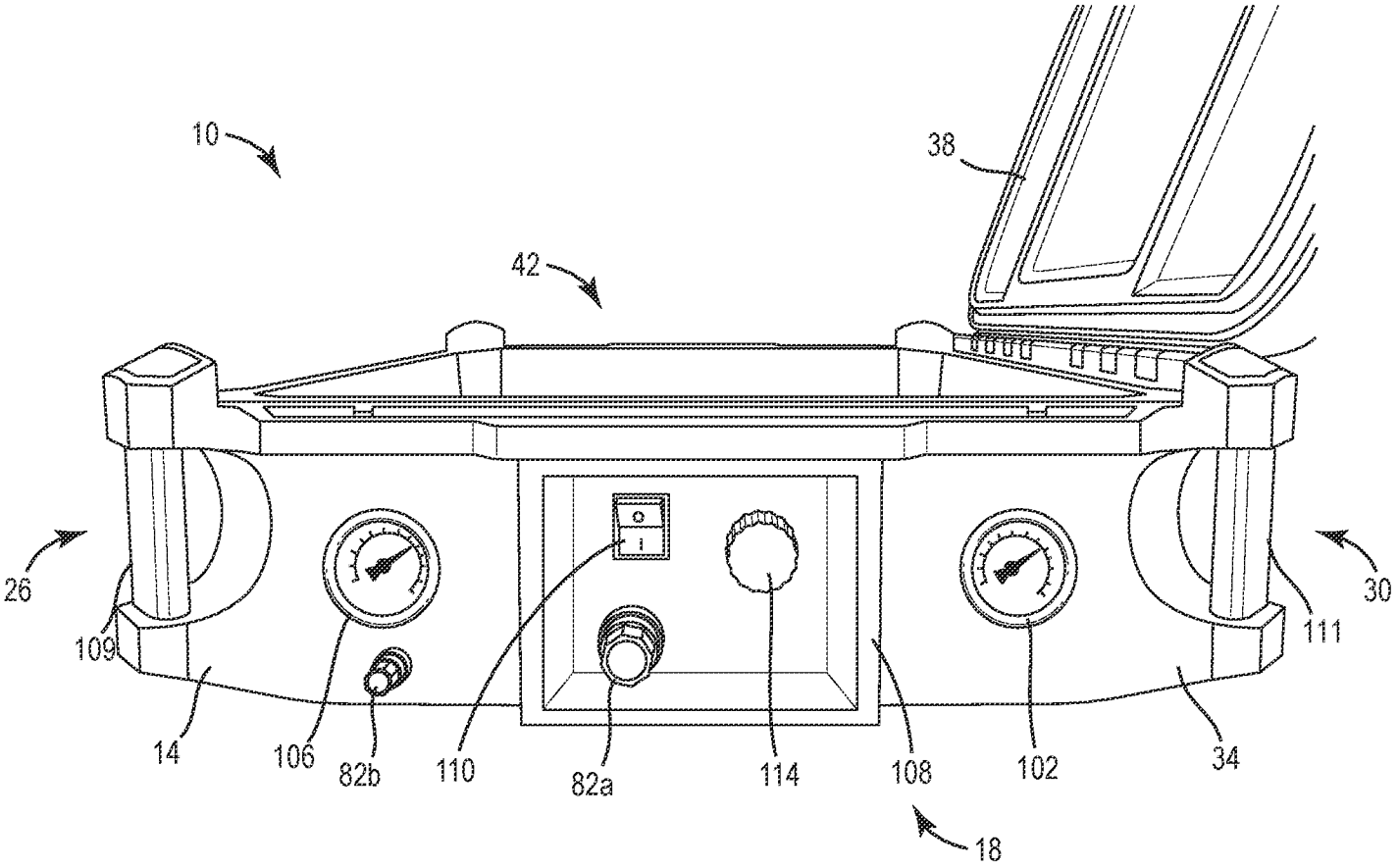
FIG. 2 is a side view of the air compressor of FIG. 1.

FIGS. 1 and 2 illustrate a portable air compressor 10 including a housing (e.g., a case 14) having a front side 18, a rear side 22 (FIG. 1), and left and right sides 26, 30. The illustrated case 14 includes a base 34 and a lid 38 that is selectively openable by a user to allow access to an interior 42 of the case 14 (FIG. 2). The case 14 further includes a handle 46 (FIG. 1) on the left side 26 to facilitate transporting the compressor 10 when the lid 38 is closed. In some embodiments, the case 14 is made from a sound dampening material that attenuates the noise emitted by the compressor 10 while being operated.

Figure 3:
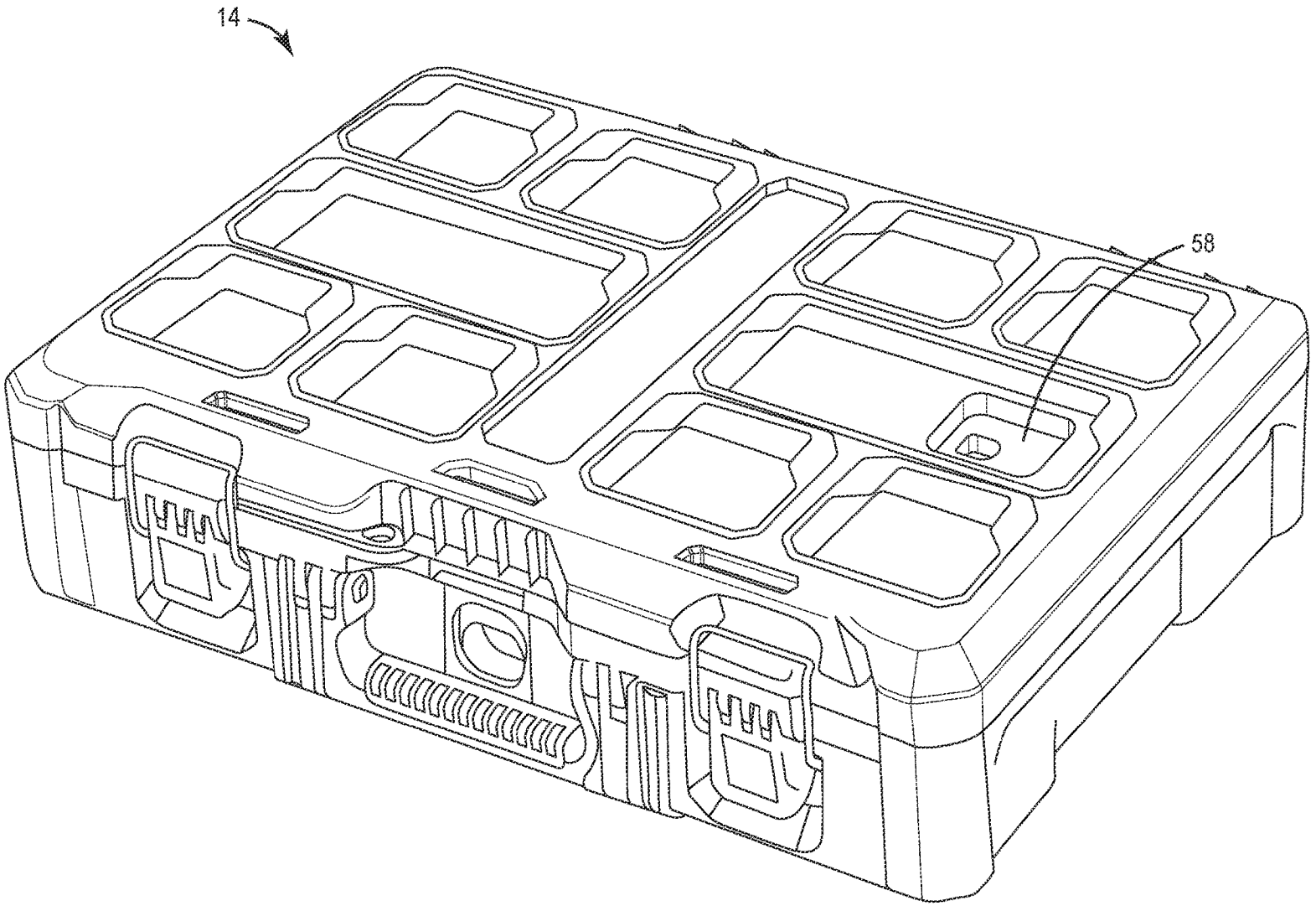
FIG. 3 is a perspective view of an air compressor according to another embodiment of the invention.

With reference to FIG. 1, the compressor 10 includes a compressor assembly 50 and a battery receptacle 58, each of which is located within the interior 42 of the case 14. A battery 62 is removably coupled to the battery receptacle 58 to provide electrical power to an electric motor 54, which is a component of the compressor assembly 50. The illustrated battery 62 is a power tool battery pack with a plurality of rechargeable battery cells (e.g., lithium-based battery cells; not shown) providing the battery 62 with a nominal output voltage of about 18V. In other embodiments, the battery 62 can have a different nominal voltage, such as, for example, 12V, 36V, or 40V. Alternatively, the compressor 10 may include a power cord connectable with a wall outlet or other AC power source, such as an inverter generator. As shown in FIG. 3, in some embodiments, the battery receptacle 58 may be located on the exterior of the case 14, allowing a user to change the battery 62 without opening the lid 38.

With reference to FIG. 1, the compressor assembly 50 further includes a pump 66 that is driven by the motor 54, which in the illustrated embodiment is a DC electric motor and may be a brushed or brushless. The pump 66 is a single-piston reciprocating pump 66 that pressurizes ambient air at atmospheric pressure for storage in a storage tank 74 (via a hose 78), which is also enclosed in the interior 42 of the case 14. In other embodiments, the pump 66 may be a multi-piston reciprocating pump (i.e., more than one piston). The storage tank 74 holds the compressed air until it is needed.

The compressor 10 also includes a pressure regulator 98 in communication with the compressor assembly 50. A portion of the pressure regulator 98 is enclosed within the interior 42 of the case 14. The storage tank 74 is in fluid communication with the pressure regulator 98 via hose 86*a*. The compressor 10 further includes two outlet ports—a regulated outlet port 82*a* (FIG. 2) that receives compressed air at a regulated pressure determined by the pressure regulator 98, and an unregulated outlet port 82*b* that receives compressed air directly from the storage tank 74 via hose 86*b*. The outlet ports 82*a*, 82*b* include a quick-disconnect configuration for selective attachment to a flexible air hose. The outlet ports 82*a*, 82*b* are capable of delivering compressed air simultaneously. Alternatively, only one of the outlet ports 82*a*, 82*b* may be usable at a time.

With continued reference to FIG. 2, the compressor 10 includes a first gauge 102 that displays the regulated pressure of the compressed air discharged from the regulated outlet port 82*a*, and a second gauge 106 that displays the pressure within the storage tank 74. Although not illustrated, the compressor 10 may include a pressure switch that detects the pressure within the storage tank 74. If the detected pressure within the storage tank 74 is below a predetermined minimum value, the pressure switch activates the compressor assembly 50 to refill the storage tank 74 until the pressure in the storage tank 74 reaches a predetermined maximum value, at which time the pressure switch deactivates the compressor assembly 50.

As illustrated in FIG. 2, the compressor 10 includes a control panel 108 disposed on the front side 18 of the case 14 having a power button 110 to selectively activate the compressor assembly 50 and an adjustment knob 114. The adjustment knob 114 may be rotated to set the regulated pressure provided by the outlet port 82*a* depending upon the intended use of the discharged compressed air. The regulated outlet port 82*a* extends through the control panel 108. Alternatively, the unregulated outlet port 82*b* may also extend through the control panel 108.

With continued reference to FIG. 2, the case 14 includes a first mounting rail 109 and a second mounting rail 111. The second mounting rail 111 may be spaced apart from the first mounting rail 109. The first and second mounting rails 109, 111 are configured to mount accessories to the case 14. For example, hooks, tool bins, and extension cords may all be mounted to the case 14 with the mounting rails 109, 111.

Figure 4:
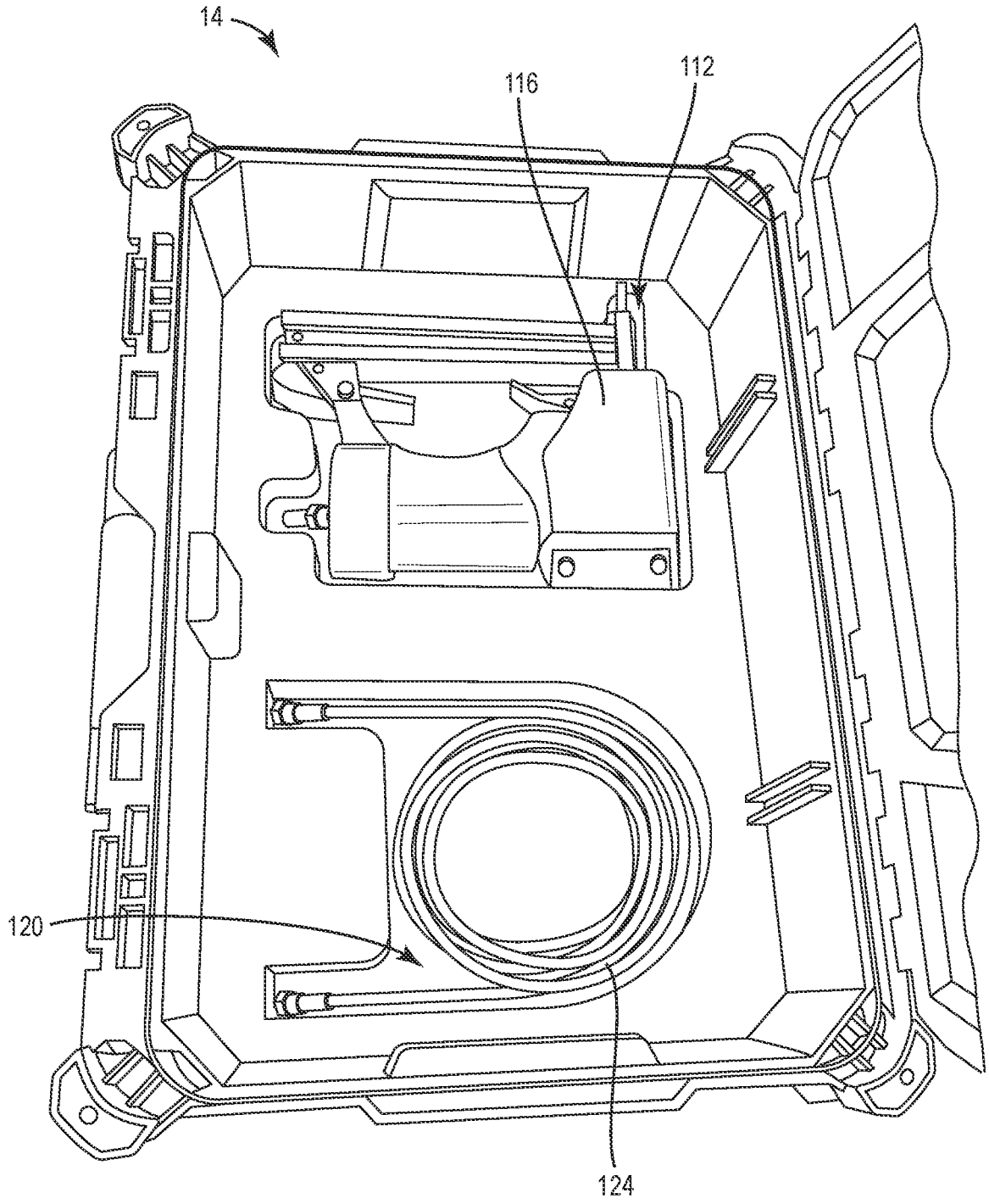
FIG. 4 is a perspective view of an air compressor according to another embodiment of the invention.

In some embodiments, the case 14 may include a storage compartment for a separate tool or device, such as, a hose, a nailer or other accessories. For example, as shown in FIG. 4, the case 14 may include a first recess 112 that receives a pneumatic tool 116. The case 14 may further include a second recess 120 that receives an air hose 124. The air hose 124 fluidly connects the storage tank 74 to the pneumatic tool 116. The pneumatic tool 116 may then be used in conjunction with the compressor 10 as a self-contained system, with the tool 116, the air hose 124, the compressor assembly 50, the battery receptacle 58, and the storage tank 74 being removable from the case 14 to access the tool 116 and hose 124.

Figure 5:
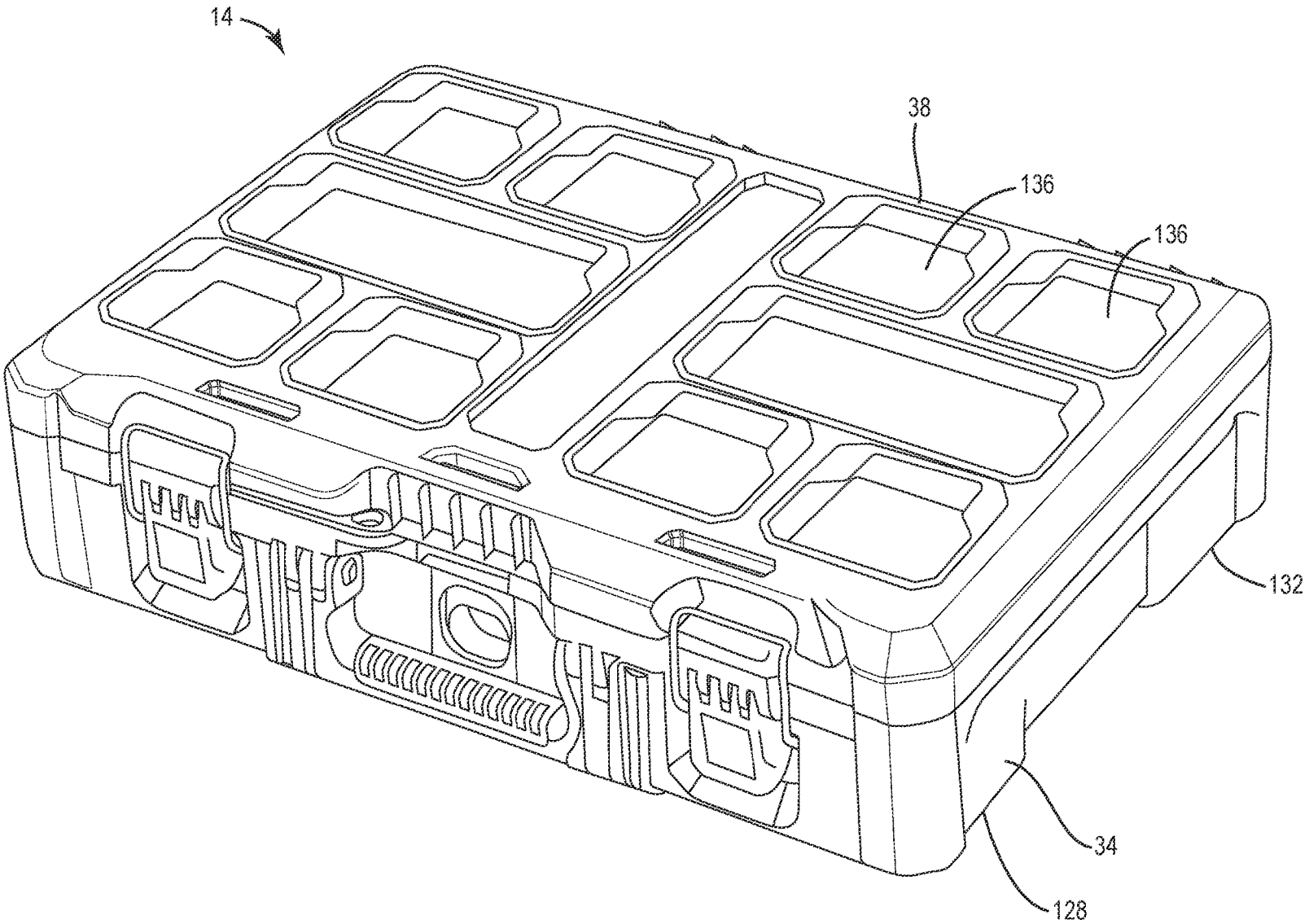
FIG. 5 is a perspective view of a case of the air compressor of FIG. 1.

With reference to FIG. 5, the case 14 includes features on the base 34 and/or the lid 38 that allow the case 14 to be coupled to similar cases having similar features. Such coupling features are described in International Patent Application No. PCT/US2018/044629 filed Jul. 31, 2018, now International Patent Application Publication No. WO 2019/028041, the entire content of which is incorporated herein by reference. For example, the case 14 may include projections 128 on a bottom surface 132 of the base 34. The projections 128 on the case 14 are receivable within recesses 136 on the lid 38 of another case. As such, one or more additional cases can be coupled (e.g., in a stacked arrangement).

Figure 6:
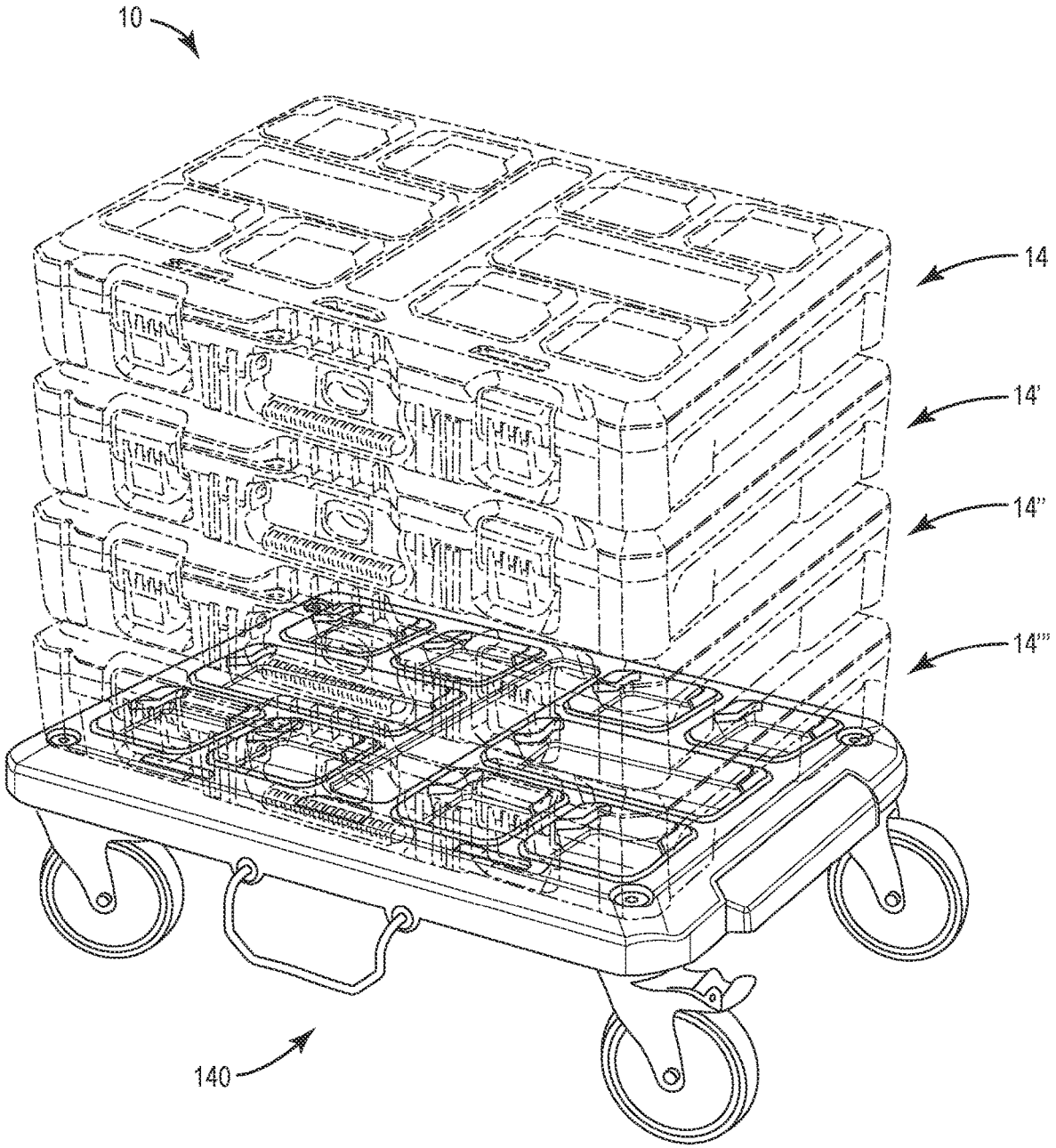
FIG. 6 is a perspective view of multiple cases of FIG. 5.

In a similar manner, additional storage tank modules, each comprising one or more additional storage tanks 74 for storing additional compressed air and enclosed within respective cases identical to the case 14 of the compressor 10, may be fluidly interconnected with one or more compressor modules (i.e., one or more of the compressors 10). For example, the compressor modules and the storage tank modules may be fluidly connected by external hoses or via integrated inlet/outlet ports in the respective cases. The cases of the storage tank modules may also include coupling features, like any of those disclosed in International Patent Application No. PCT/US2018/044629, for connection to the cases 14 of one or more compressor modules to secure the cases of the compressor and storage tank modules together (e.g., in a stacked arrangement). For example, as shown in FIG. 6, a first case 14 may include the compressor assembly 50 and a second case 14' may include the storage tank 74. In addition, a third and fourth case 14", 14'" may include additional storage tanks 74 and/or other accessories for the compressor 10. The multiple cases 14, 14' 14", 14'" may be transported using a wheeled cart 140.

In one embodiment, the case 14 limits the sound produced by the compressor assembly 50 to less than 68 decibels when the lid 38 is closed. In another embodiment, the case 14 limits the sound produced by the compressor assembly 50 to less than 58 decibels when the lid 38 is closed. In further embodiments, the compressor assembly 50 can fill a storage tank 74 having a volume of 0.5 liter, 1 liter, 1.5 liters, or 2 liters with compressed air at a pressure between 75 psi and 125 psi, while producing less than 58 decibels of sound. In some embodiments, the compressor 10 may include a vibration isolation mount between the case 14 and the compressor assembly 50 to further lower the decibels produced by the compressor assembly 50.

In the illustrated embodiment, the case 14 has a low profile that is convenient for carrying. In some embodiments, the case 14 has a width, defined between the left and right sides 26, 30 of the case 14 that is less than 12 inches. In other embodiments, the case 14 has a width that is less than 8 inches. In a further embodiment, the case 14 has a width that is six inches or less.

In further embodiments, the compressor 10 includes a mode selector. The mode selector can select between a performance mode (in which the compressor assembly 50 runs at a higher capacity) and a second mode (in which the compressor assembly 50 runs at a lower capacity and lower sound level).

Various features of the invention are set forth in the following claims.

What is claimed is:

1. An air compressor comprising:

a compressor assembly including an electric motor and a pump driven by the motor;

a battery compartment case;

a battery receptacle within the battery compartment case;

a battery pack electrically connected to the motor via the battery receptacle for providing electrical power to the motor, the battery receptacle and the battery pack being positioned adjacent the compressor assembly;

a storage tank that receives compressed air from the pump;

a compressor assembly case separate from the battery compartment case, the compressor assembly case entirely enshrouding the compressor assembly;

an outlet port in fluid communication with the storage tank;

an adjustable pressure regulator at least partially positioned within the case, the outlet port configured to discharge compressed air from the storage tank at a regulated pressure determined by the pressure regulator; and an adjustment knob to adjust the regulated pressure of compressed air provided by the outlet port;

wherein the compressor assembly case attenuates noise emitted by the compressor assembly to less than 68 decibels.

2. The air compressor of claim 1, wherein the pump is a single-piston reciprocating pump.

3. The air compressor of claim 1, further comprising a gauge that displays the regulated pressure of the compressed air discharged from the outlet port.

4. The air compressor of claim 1, further comprising an actuator to selectively activate the compressor assembly.

5. The air compressor of claim 1, wherein the compressor assembly fills the storage tank with compressed air at a pressure between 75 psi and 125 psi while producing less than 68 decibels of noise.

6. The air compressor of claim 1, wherein the battery pack is removably coupled to the battery receptacle.

7. The air compressor of claim 1, wherein the battery pack includes a plurality of rechargeable battery cells.

8. The air compressor of claim 1, further comprising a handle to facilitate transporting the air compressor.

9. The air compressor of claim 1, further comprising a vibration isolating mount between the compressor assembly case and the compressor assembly.

10. The air compressor of claim 1, wherein the storage tank is supported by the compressor assembly case.

11. The air compressor of claim 1, wherein the compressor assembly case defines an interior, and wherein the compressor assembly case includes a base and a lid that is selectively openable by a user to allow access to the interior.

12. An air compressor comprising:

a compressor assembly including an electric motor and a pump driven by the motor;

a storage tank that receives compressed air from the pump;

a battery receptacle;

a battery pack electrically connected to the motor via the battery receptacle for providing electrical power to the motor, the battery receptacle and the battery pack being positioned adjacent the compressor assembly;

a case supporting the battery receptacle and the battery pack;

an outlet port in fluid communication with the storage tank;

an adjustable pressure regulator at least partially positioned within the case, the outlet port configured to discharge compressed air from the storage tank at a regulated pressure determined by the pressure regulator; and a control panel disposed on a first side of the case, the control panel including an adjustment knob to adjust the regulated pressure of compressed air provided by the outlet port, a gauge that displays the regulated pressure of the compressed air discharged from the outlet port, and an actuator to selectively activate the compressor assembly;

wherein noise emitted by the compressor assembly is less than 68 decibels.

13. The air compressor of claim 12, wherein the pump is a single-piston reciprocating pump.

14. The air compressor of claim 12, wherein the compressor assembly fills the storage tank with compressed air at a pressure between 75 psi and 125 psi while producing less than 68 decibels of noise.

15. The air compressor of claim 12, wherein the battery pack is removably coupled to the battery receptacle.

16. The air compressor of claim 12, wherein the battery pack includes a plurality of rechargeable battery cells.

17. The air compressor of claim 12, further comprising a handle to facilitate transporting the air compressor.

18. The air compressor of claim 12, further comprising a vibration isolating mount between the case and the compressor assembly.

19. The air compressor of claim 12, wherein the compressor assembly and the storage tank are supported by the case.

20. The air compressor of claim 12, wherein the case defines an interior, and wherein the case includes a base and a lid that is selectively openable by a user to allow access to the interior.

21. The air compressor of claim 12, wherein the case is a battery compartment case, and wherein the compressor further comprises a compressor assembly case separate from the battery compartment case that supports the compressor assembly.

* * * * *